United States Patent [19]

Soich

[11] Patent Number: 4,822,487

[45] Date of Patent: Apr. 18, 1989

[54] POOL SKIMMER

[76] Inventor: Joseph Soich, 2705 Riverton Rd., Cinnaminson, N.J. 08077

[21] Appl. No.: 126,062

[22] Filed: Nov. 27, 1987

[51] Int. Cl.[4] ..... E04H 3/20

[52] U.S. Cl. ..... 210/238; 210/470; 210/241; 15/1.7; 209/417

[58] Field of Search ..... 210/169, 237, 238, 923, 210/470, 924, 523, 528, 241; 15/1.7, 144 R, 144 B; 209/374, 417, 418, 359; 294/55, 53.5

[56] References Cited

U.S. PATENT DOCUMENTS

| | | | |
|---|---|---|---|
| 562,362 | 6/1896 | Koetzner et al. | 15/144 R |
| 889,088 | 5/1908 | Baillargeon | 15/143 B |
| 3,188,668 | 6/1965 | Buckelew | 15/1.7 |
| 3,220,037 | 11/1965 | Ruhling | 15/1.7 |
| 3,863,237 | 1/1975 | Doerr | 210/169 |
| 3,979,146 | 9/1976 | Berg | 15/1.7 |
| 4,013,563 | 3/1977 | Petrik | 210/470 |
| 4,152,801 | 5/1979 | Lieber | 210/470 |
| 4,198,720 | 4/1980 | Matsumoto | 15/1.7 |
| 4,369,109 | 1/1983 | Edge | 210/238 |

*Primary Examiner*—Richard V. Fisher
*Assistant Examiner*—Coreen Y. Lee
*Attorney, Agent, or Firm*—Norman E. Lehrer

[57] ABSTRACT

A skimming device for a swimming pool includes an elongated rectangular frame having a screen extending within the area bounded by the frame. A telescoping elongated handle is connected to the frame and extends in the same plane as said frame but outwardly therefrom. The angle of the handle can be adjusted to extend upwardly and outwardly from the frame thereby allowing a person to hold the handle while suspending the device in an in-ground swimming pool to thereby skim the surface of the water as he or she walks around the edge of the pool. The handle can also be adjusted to extend directly outwardly from the upper part of the frame so that the handle can rest on the upper edge of an above ground pool as the skimming device skims the surface of the water.

11 Claims, 2 Drawing Sheets

POOL SKIMMER

BACKGROUND OF THE INVENTION

The present invention is directed toward a pool skimmer and more particularly toward a simple manually operated device which can be used to skim and thereby clean the upper surface of either an in-ground or above-ground swimming pool.

Those who own or must maintain a swimming pool are well aware of the problems involved in keeping the same clean, safe and inviting. Metal objects, stones and other debris often fall to the bottom of the pool while leaves, insects and other types of light or more buoyant debris float on the surface for extended periods. All such unsightly debris, however, must periodically be cleaned from the pool since it can become both a safety and health hazard.

Built-in automatic skimmers of swimming pools are not very effective in removing the surface debris. Furthermore, such automatic systems can easily become clogged. Thus, there remains the need for periodically manually cleaning debris from a pool.

The largest majority of pool cleaning devices which are on the market and have been proposed resemble a fishing net or the like and include a substantially oval-shaped frame having netting material suspended therefrom and a handle extending outwardly from the frame. Such devices are shown, for example, in U.S. Pat. Nos. 3,220,037; 3,368,686; 4,152,801; 4,198,720 and 4,481,117.

While these prior art patents can be used to skim the top surface of a pool in varying degrees of effectiveness, they are designed and are more useful for picking up specific objects from the bottom of a pool. The shape of the net, the size of the net opening and the angles at which the handles extend from the netting frame make it extremely difficult and time consuming to use these devices to effectively skim the surface of a pool.

Devices have also been proposed specifically for cleaning or skimming only the surface of a swimming pool. U.S. Pat. Nos. 4,053,412 and 4,089,074, for example, show floating net devices which are intended to be positioned adjacent to the edge of a pool to collect debris from the surface water as it passes through the net. However, these nets are relatively small and are located in only one location. The improbable assumption is made that all of the surface water will pass through the net. This simply does not occur, and the limited skimming capability is completely lost when the pool water pump is not operating. Pool pumps are seldom operated more than 8 to 10 hours per day. Cleaning of the debris from the nets is very awkward and time-consuming.

The pool skimming net shown in U.S. Pat. No. 4,369,109 is somewhat larger than previously described devices and is rectangular in shape so as to cover a larger area of the pool surface. However, this device is intended to be rigidly fixed to the side edge of an in-ground pool and, again, can only clean all of the surface water if it all passes through the netting. Again, highly improbable. Furthermore, if the direction of water flow should change for any reason such as shutting off the pool pump, any debris which had collected on one side of the net would be dislodged therefrom and would simply fall back into the water. Cleaning of the net would be time-consuming primarily due to the need of unfastening it from the mounting bracket. The permanently mounted bracket would also present a hazard to bathers when the net is not used.

The device shown in U.S. Pat. No. 4,557,001 is also specifically designed to clean debris from the surface of a pool. This device is comprised of an elongated flexible floating net which is fixed to the pool at one end. With the use of an elongated handle, the other end of the flexible net is maneuvered around the pool so that debris is collected in the loop formed by the device. While, in principle, it would appear that this device could easily and quickly clean debris from the surface of a pool, the device is approximately 20 to 40 feet long. Thus, once the debris is collected, it is almost impossible to withdraw the device from the water without losing most of the debris back into the water. Complete cleaning of the netting is again awkward and time-consuming. Furthermore, this patented device must be used to clean the entire pool and cannot reasonably be used to spot clean, i.e. to clean debris from a limited area.

SUMMARY OF THE INVENTION

The present invention is designed to overcome the deficiencies of the prior art and is particularly useful for cleaning debris from the surface of a swimming pool. The skimming device of the present invention includes an elongated rectangular frame having a screen extending within the area bounded by the frame. A telescoping elongated handle is connected to the frame and extends in the same plane as said frame but outwardly therefrom. The angle of the handle can be adjusted to extend upwardly and outwardly from the frame thereby allowing a person to hold the handle while suspending the device in an in-ground swimming pool to thereby skim the surface of the water as he or she walks around the edge of the pool. The handle can also be adjusted to extend directly outwardly from the upper part of the frame so that the handle can rest, if desired, on the upper edge of an above-ground pool as the skimming device skims the surface of the water.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
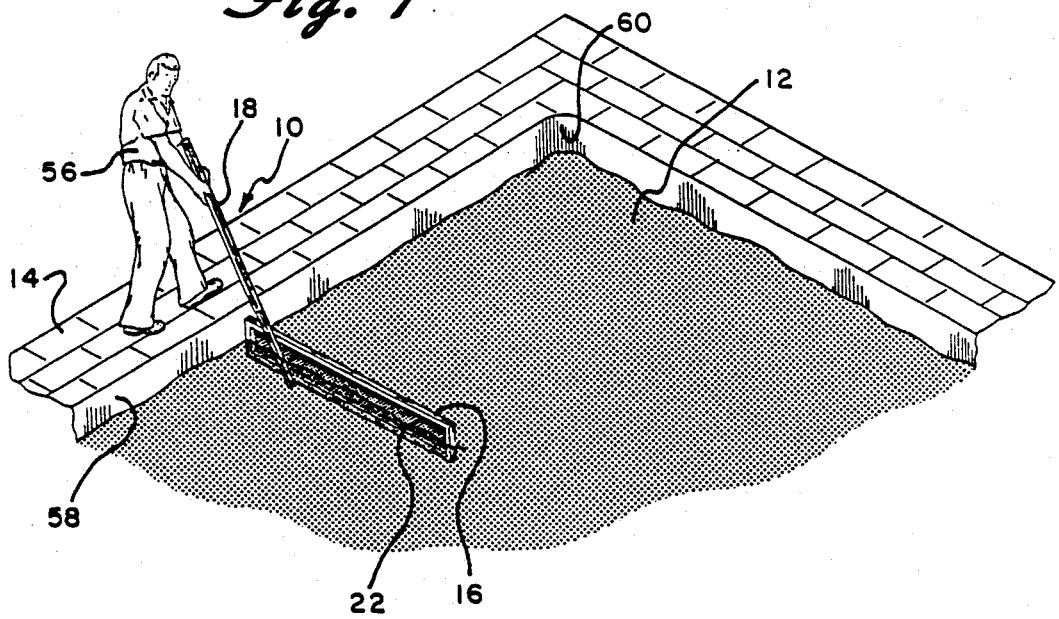
FIG. 1 is a perspective view of a skimming device constructed in accordance with the principles of the present invention and being shown in use by a person cleaning the surface of an in-ground swimming pool.

Referring now to the drawings in detail wherein like reference numerals have been used throughout the various figures to designate like elements, there is shown in FIG. 1 a pool skimmer constructed in accordance with the principles of the present invention and designated generally at 10. The pool skimmer 10 is shown being used to clean the surface of the water 12 in an in-ground swimming pool 14. The actual process for cleaning the pool 14 will be described in more detail hereinafter.

Figure 2:
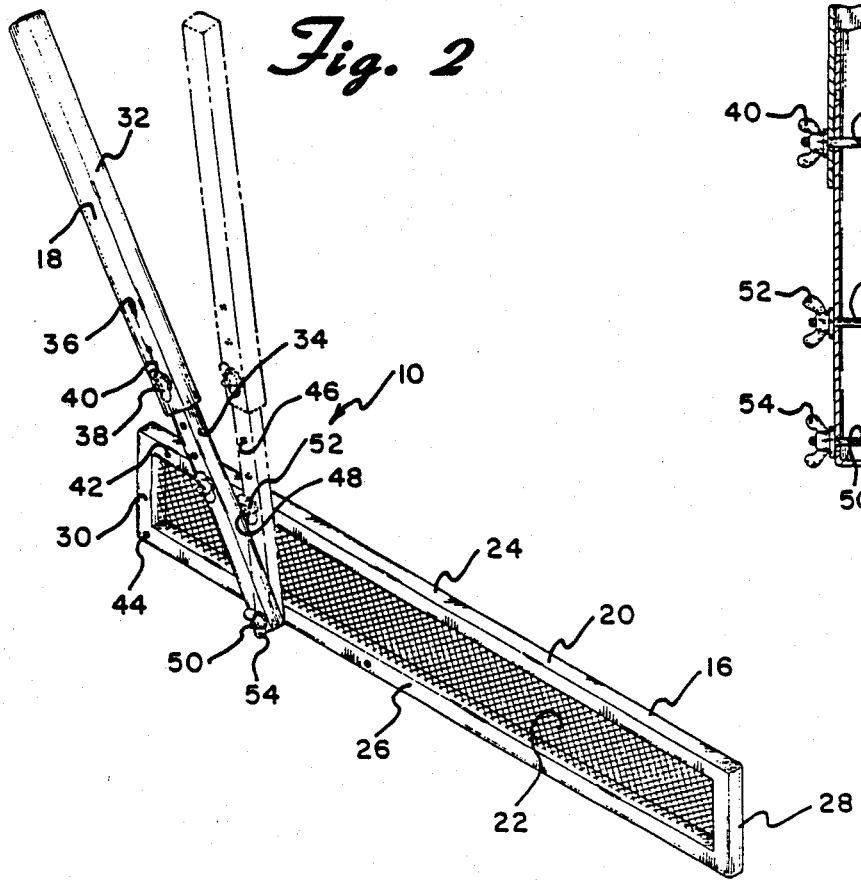
FIG. 2 is a perspective view of the device shown in FIG. 1 showing the manner in which the handle thereof is adjustable.
Figure 3:
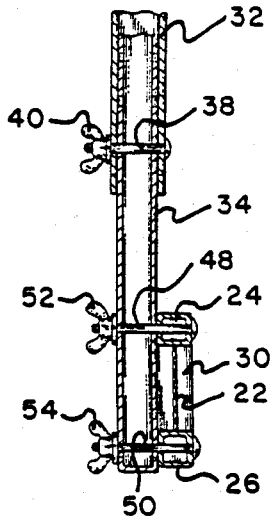
FIG. 3 is a partial cross-sectional view of FIG. 2.

The skimming device 10 is shown more clearly and in more detail in FIG. 2. The device is comprised essentially of two major parts: a skimmer 16 and a handle 18. The skimmer 16 includes a substantially rectangularly shaped elongated frame 20 having a screen 22 located within the area bounded by the frame and secured thereto. As shown in FIG. 3, the screen 22 is preferably relatively taut.

The frame 20 is itself comprised essentially of an upper substantially elongated and horizontally disposed frame member 24 and a lower elongated and substantially horizontally disposed frame member 26 which is spaced from the frame member 20. Vertically arranged side frame members 28 and 30 connect the ends of the upper and lower frame members.

The frame members 24, 26, 28 and 30 are preferably made of tubular metal and preferably have a substantially rectangular cross section. The individual frame members may be separately made and joined together to form the rectangular frame using substantially any known joining means or it may be possible to integrally form the frame members into the desired shape. While other sizes may be possible, it has been found that an overall length of approximately 6 feet and an overall height of approximately 10 inches for the skimmer 16 best accomplishes the desired results of the invention.

The handle 18 is also preferably made of tubular metal having a substantially rectangular cross section. The handle is elongated and is also preferably made in two parts, 32 and 34, which telescope with respect to each other so that the length of the handle 18 may be changed. Either or both of the handle portions 32 and 34 may be provided with a plurality of apertures 36 which may be used to adjust the length of the handle. Once the proper length is selected, the handle parts are held together through the use of bolt 38 which passes through the desired apertures and wing nut 40 which secures the parts together.

Both the upper and lower frame members 24 and 26 are provided with a plurality of apertures such as shown at 42 and 44. These apertures pass entirely through the frame members and are substantially perpendicular to the plane thereof. The lower handle portion 34 of the handle 18 is also provided with a plurality of apertures 46 which pass therethrough. Bolts 48 and 50 and wing nuts 52 and 54 are used to secure the handle 18 to the frame 20.

When the device is intended to be used to clean an in-ground swimming pool 14, an arrangement such as shown in FIG. 2 is utilized. In this arrangement, the lowermost end of the handle portion 34 is attached to the lower frame member 26 through bolt 50 and wing nut 54 utilizing one of the apertures therein. Although the aperture chosen in FIG. 2 is shown to be closer to the left of the frame, it is, in most cases, desirable to attach the lower end of the handle closer to the center of the lower frame member 26. The proper hole 42 on the upper frame member 24 is then aligned with the proper hole 46 in the handle 18 so as to provide the proper desired angle. The bolt 48 and wing nut 52 then secure the handle in position.

Although there may be some instances when it is desired to have the handle extend straight upwardly, it can be seen from FIG. 1 that the most convenient position for the handle is for the same to extend upwardly and outwardly at an acute angle relative to the major axis of the skimmer 16. In this position, a person such as shown at 56 can hold the handle 18 in a manner similar to the manner in which one grips a golf club so that the skimmer portion 16 is substantially horizontal with approximately half of the skimmer lying beneath the surface of the water and half above the same. The user can then walk clockwise around the pool using the inside edge 58 of the pool as a guide for the vertical frame member 30 of the skimmer. Since the corners of most pools are rounded such as shown at 60, the movement around the pool can be continuous.

After the debris has been collected on the face of the screen 22, the user merely has to rotate the entire device upwardly to lift the skimmer portion 16 out of the water. To remove the debris from the screen, the user simply turns the screen substantially upside down and taps the lower frame member 26 (that edge opposite the face where the handle is connected) on a hard surface. Any debris on the screen will then simply drop off.

Figure 4:
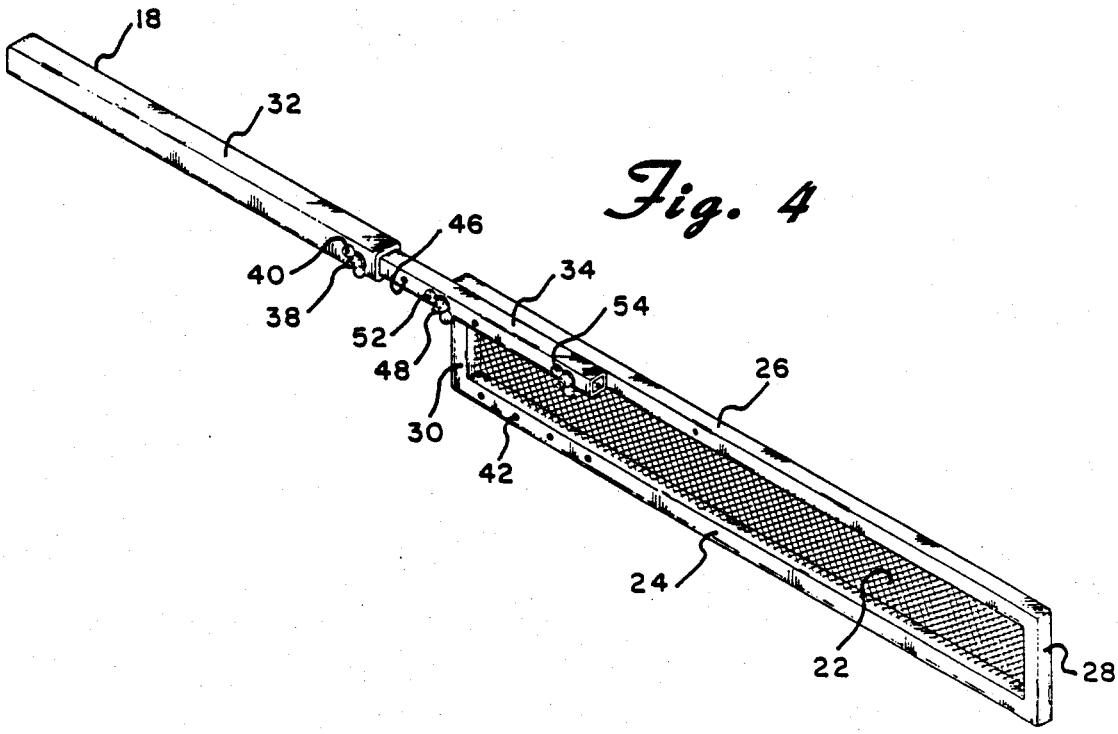
FIG. 4 is a view similar to FIG. 2 showing the handle rearranged so that the device can be used to clean an above-ground swimming pool.

The device shown in FIG. 4 is identical to that shown in FIG. 2 but with the handle readjusted so that the same can be used to clean an above-ground pool. This arrangement is accomplished by simply loosening wing nut 52 and removing bolt 48 and then pivoting the handle until the same is in substantial axial alignment with the frame member 26. At this time, the bolt 48 and wing nut 52 are resecured. While the angle of the handle 18 has been changed in FIG. 4 relative to the axis of the skimmer 16, it can be seen that the handle continues to lie in substantially the same plane as the frame 20 just as it did in the embodiment shown in FIG. 2. It should also be noted that the skimmer portion 16 of the device 10 as shown in FIG. 4 has been reoriented. That is, the lower frame member 26 becomes the upper frame member while the upper frame member 24 becomes the lower frame member.

Figure 5:
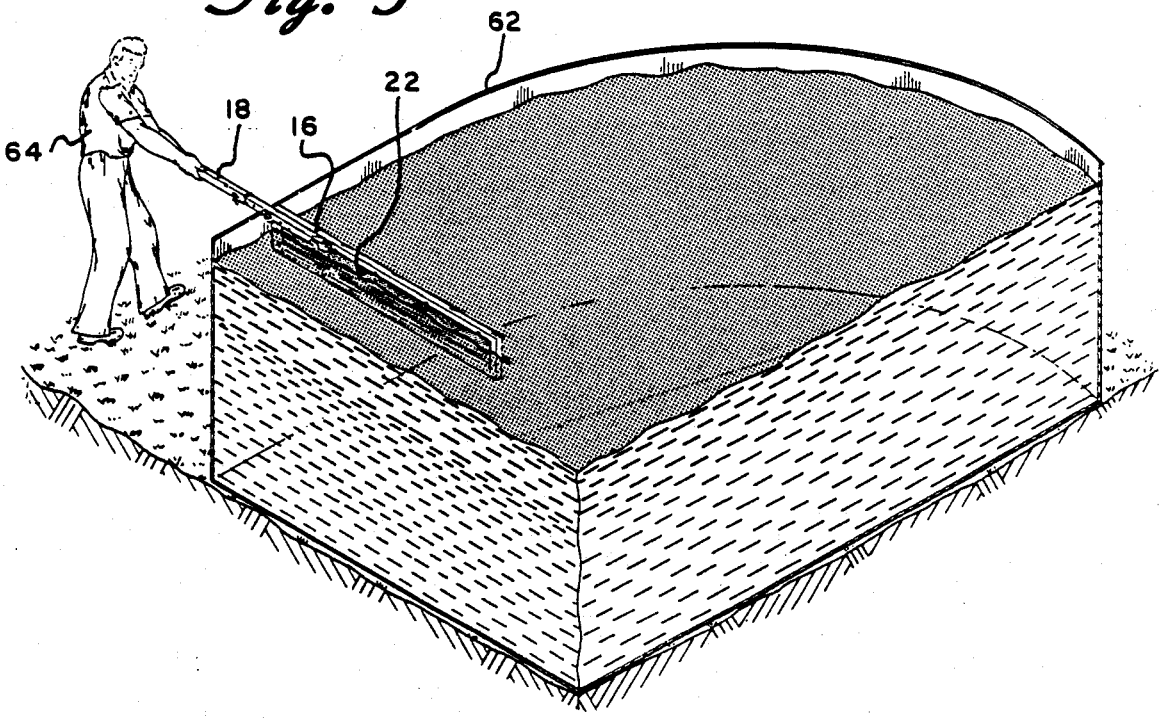
FIG. 5 is a view similar to FIG. 1 showing the device being used to clean the surface of an above-ground swimming pool.

Furthermore, it should be readily apparent to those skilled in the art that the handle shown in FIGS. 4 and 5 are on the opposite side of the frame. The handle can be used on either side as desired by simply removing the bolts 48 and 50, moving the handle to the opposite side and reinserting the bolts.

The device shown in FIG. 4 is particularly useful for cleaning the surface of an above-ground pool as shown in FIG. 5. With the skimmer 16 lying substantially horizontal with approximately half of the screen 22 being above water and half below the water, the handle 18 can rest, if desired, on the upper edge 62 of the pool. Gripping the handle in a manner similar to that shown in FIG. 1, the user 64 can then walk around the pool with the vertical frame member 30 again guiding the device around the edge of the pool.

The present invention may be embodied in other specific forms without departing from the spirit or essential attributes thereof and accordingly reference should be made to the appended claims rather than to the foregoing specification as indicating the scope of the invention.

I claim:

1. A skimming device for a swimming pool comprising:

a substantially rectangularly shaped elongated frame means, said frame means having a major axis and a minor axis and including upper and lower substantially horizontal spaced apart elongated frame members and substantially vertically arranged side frame members extending between and connecting the ends of said upper and lower members, said frame means defining and substantially lying within a single plane;

screen means connected to each of said frame members and extending throughout the area surrounded by said frame members, said screen means being relatively taut and substantially lying within the same plane as said frame means;

elongated substantially rigid handle means extending from said frame means, said handle means being connected to said frame means and lying substantially in the same plane as said frame means, and means for adjusting the angle of said handle means relative to the major axis of said frame means with said handle means always lying substantially within said plane.

2. The invention as claimed in claim 1 wherein said means for adjusting the angle of said handle means includes means permitting said handle to be substantially axially aligned with at least one of said upper and lower frame members.

3. The invention as claimed in claim 1 wherein said means for adjusting the angle of said handle means includes means permitting said handle means to extend from said frame means at an acute angle relative to the major axis of said frame means.

4. The invention as claimed in claim 1 wherein said means for adjusting includes a plurality of apertures located in said frame members and in said handle means.

5. The invention as claimed in claim 4 wherein the axes of said apertures are perpendicular to the plane of said frame means.

6. The invention as claimed in claim 1 wherein the length of said handle means is adjustable.

7. The invention as claimed in claim 6 wherein said handle means is comprised of a plurality of telescoping parts.

8. The invention as claimed in claim 1 wherein said frame members have a rectangular cross section.

9. The invention as claimed in claim 8 wherein at least that portion of said handle means adjacent said frame means has a rectangular cross section.

10. The invention as claimed in claim 9 wherein said handle means has a rectangular cross section substantially throughout its entire length.

11. The invention as claimed in claim 1 wherein said frame members are comprised of tubular metal.

* * * * *